US005199351A

United States Patent [19]

Shibuya et al.

[11] Patent Number: 5,199,351

[45] Date of Patent: Apr. 6, 1993

[54] ANGLE-BAR DEVICE FOR USE IN ROTARY PRINTING PRESS

[75] Inventors: Yasuo Shibuya; Tohru Higuchi, both of Tokyo, Japan

[73] Assignee: Kabushiki Kaisha Tokyo Kikai Seisakusho, Tokyo, Japan

[21] Appl. No.: 772,293

[22] Filed: Oct. 7, 1991

[30] Foreign Application Priority Data

Oct. 8, 1990 [JP] Japan ..... 2-268541

[51] Int. Cl.[5] ..... B41F 13/06

[52] U.S. Cl. ..... 101/228; 226/197

[58] Field of Search ..... 101/348, 349, 350, DIG. 38, 101/228, 219, 181; 226/196, 197, 198, 199, 42

[56] References Cited

U.S. PATENT DOCUMENTS 2,884,856 5/1959 Brodie ..... 226/197
4,155,496 5/1979 Houck ..... 226/197 X
5,020,431 6/1991 Shibuya ..... 101/228

FOREIGN PATENT DOCUMENTS 2-46627 3/1990 Japan .

OTHER PUBLICATIONS

"Turning Bar" from lines 23rd to 33rd, on the right column, p. 237 of Revised and Enlarged Printing Dictionary (First edition issued by choyo society, Printing Bureau on Jun. 30th Showa 62nd).

*Primary Examiner*—J. Reed Fisher
*Attorney, Agent, or Firm*—Armstrong, Westerman, Hattori, McLeland & Naughton

[57] ABSTRACT

The present invention provides an angle-bar device for use in a rotary press, which aims at removing ink and paper debris, etc deposited on the whole peripheral surfaces of the angle-bars by rotating the angle-bars continuously so as to increase the tension on the paper web which is running around and between the angle-bars. This angle-bar device comprises: at least two pieces of angle-bars (1*a*; 1*b*) disposed rotatively on the upstream and downstream sides, respectively, of the direction of running of a paper web; driving means (2*a* ; 2*b*) each for rotatively driving each of the angle-bars; a start controlling means (3) connected operatively with the driving means and adapted to control the starting of the driving means. The device further comprises an operation controlling means (4) for detecting the operating condition of the rotary printing press, which is connected with the start controlling means (3) so that it can send out output signal to the start controlling means. Each of the driving means (2*a* ; 2*b*) drives each of the upstream and downstream angle-bars at a preset rotational speed and in a preset direction of rotation.

6 Claims, 2 Drawing Sheets

ANGLE-BAR DEVICE FOR USE IN ROTARY PRINTING PRESS

BACKGROUND OF THE INVENTION

1. Field of the Invention

This invention relates to an angle-bar device used for changing the direction of running of paper webs in a rotary printing press which is put to use by allowing the paper webs to run continuously along their respective paths.

2. Description of the Prior Art

In an angle-bar device for use in a rotary printing press using paper webs, during the operation of the rotary printing press, portions of each of the angle-bars just in front and just in rear of a paper web guiding zone around which a running paper web W is guided in contact therewith are deposited with ink and paper dust from the paper web thereby forming deposits "a", "b". These deposits give not a little bad influence on the paper web running around the angle-bars, which includes, for example, spoiling the portions of the paper web which are brought into contact with the angle-bars, and application of irregular tension on the running paper web, etc.

Thereupon, to prevent the angle-bars from being deposited with ink and paper dust, etc., the following measures are disclosed. For example, in the article entitled "Turning Bar" from lines 23rd to 33rd, on the right column, page 237 of "Revised and Enlarged Printing Dictionary" (First edition issued by choyō society, Printing Bureau on 30th June Showa 62nd), there are described a method of rotating the turning bars or the angle-bars little by little to prevent the turning bars from being desposited with ink and paper dust, etc.,and another method for blowing off air to maintain a clearance between each of the angle bars and the paper web. Further, described in the publication of Japanese Laid-open Utility Model Application No. HEI 2-46627 is an apparatus for ejecting air from openings formed in the peripheral surfaces of turning bars or angle-bars to space a paper web from the peripheral surfaces to thereby create a clearance between each of the angle-bars and the paper web guided therealong.

The above-mentioned method for rotating the angle-bars little by little is aiming at rotating the angle-bars to constantly change the paper web guiding zones and the portions just in front and just in rear of the guiding zones, thereby preventing these portions from being deposited with ink and paper dust, etc. However, in rotary printing presses of today for printing newspaper wherein paper webs are run at about 10 meters per second, since deposition of ink and paper dust, etc., occurs very quickly, it is necessary to rotate the angle-bars at a comparatively fast speed to prevent the occurrence of such a phenomenon. In case the angle-bars are rotated so quickly, the tension on the paper web becomes unbalanced, thus creasing or tearing it. Further, considering the paper web which is guided around the upstream and downstream angle-bars, the paper web guided around the upstream angle bar will reach a position between the upstream and downstream angle bars while it is being pulled by an upstream drag roller, whilst the paper web which has been guided around the downstream angle-bar is pulled by a downstream drag roller against the frictional force caused by the downstream angle-bar, and then drawn out. Consequently, the portion of the paper web which is guided around the peripheral surface of the downstream angle-bar and is run out therefrom is subjected to a comparatively high tension and kept in a satisfactory sliding contact with the downstream angle-bar, while the portion of the paper web which is guided around the peripheral surface of the upstream angle-bar and is run forwards therefrom is subjected to a low tension so that its sliding contact with the upstream angle-bar becomes imperfect. Therefore, even if attempt is made to wipe off ink and paper dust, etc., once deposited on the upstream and downstream bars with the paper web which is running around them while both the angle-bars are rotated little by little, such ink and paper dust, etc., cannot be completely wiped off by means of the upstream angle-bar.

On the other hand, in the above-mentioned method and device for spacing the paper web slightly away from each of the angle-bars by spouting air between them, it is required to provide either a long conduit connecting each of the angle-bars and a pressurized air supply source or an air current generator (for example, an electric-motor driven fan) directly connected to each of the angle-bars, and in spite of the need for supply of a considerably large amount of air to be spouted, the paper web cannot be held continuously in spaced apart relationship from the peripheral surfaces of the angle-bars so as to follow some change in tension on the running paper web. Consequently, in spite of the large scale of the device, the primary object of spacing the paper web away from the angle-bars cannot be achieved satisfactorily, and when the device is used for a long period of time, not only the portions of the angle-bars just in front and just in rear of the paper web guiding zones, but also the pressurized air spout holes are deposited with ink and/or paper dust, etc., so that desired result cannot always be obtained. Further, the sound generated by blowing-off of pressurized air offends the ear appreciably.

Therefore, in high speed operation rotary printing presses which have been developed of late years, ink and paper dust, etc., deposited on the angle-bars have been wiped off manually by the operators after printing operation.

However, such a wiping-off operation is time-consuming and inefficient work, and also because of the configuration of the rotary printing press the angle-bars are installed in most cases at an elevated spot where other members (for example, guide rollers) are located intricately, so that the operators are forced to assume a cramped and unstable posture with much physical and mental burden.

For this reason, it has been desired strongly from the aspects of safe operation and reduction of labor to provide an angle bar device whose peripheral surface can be kept clean without causing any trouble such as tear of paper web, etc even for high speed operation rotary printing presses.

SUMMARY OF THE INVENTION

The present invention has been made in view of the above-mentioned circumstances in the prior art, and has for its object to provide an angle-bar device wherein during the running of a paper web at least two pieces of angle-bars are rotated continuously so as to increase the tension exerted on the paper web which is running around and between the angle-bars to thereby remove ink and paper dust, etc., deposited on the whole peripheral surfaces of the angle-bars to keep them clean, and even after completion of the printing operation it is ensured no soiled portion remains on the peripheral surfaces of the angle-bars.

To achieve the above-mentioned object, according to a first aspect of the present invention, there is provided an angle-bar device for use in a rotary printing press which is put to use by allowing paper webs to run along their relevant paths, comprising: at least two pieces of angle-bars disposed rotatively on the upstream and downstream sides, respectively, of the direction of running of a paper web; driving means each for rotatively driving each of these angle-bars; and a start controlling means connected operatively with these driving means and adapted to control the starting of the driving means; wherein the arrangement is made such that each of the upstream and downstream angle-bars is rotated so as to increase the tension exerted on the paper web which is running around and between the angle-bars.

The operation of the angle-bar device according to the present invention having the above-mentioned aspect is as follows.

The driving means are actuated in response to the operation of the rotary printing press, so that the angle-bars disposed on the upstream and downstream sides, respectively, of the direction of running of the paper web are rotated little by little so as to constantly renew the paper web guiding zones on the peripheral surfaces of these angle-bars.

The directions of rotations and/or rotational speeds of the upstream and downstream angle-bars are rendered different from each other so as to increase the tension exerted on the paper web which is running around and between these angle-bars.

Because of the increase in tension on the paper web which is running around and between both the angle-bars, the paper web is always kept in good sliding contact with the peripheral surfaces of the upstream and downstream angle-bars, so that the peripheral surfaces of both the angle-bars is wiped off and kept clean.

The angle bar device according to the present invention has the following advantages.

During the running of a paper web, at least two pieces of angle-bars are rotated continuously so as to increase the tension exerted on the paper web which is running around and between the angle-bars to thereby remove ink and paper dust, etc., deposited on the whole peripheral surfaces of the angle-bars to keep them clean, and even after completion of the printing operation no soiled portion remains on the peripheral surfaces of the angle-bars.

Consequently, the physical and mental burden on the operators is relieved substantially, so that an excellent effect in improvement of operational efficiency, and hence reduction of labor can be achieved. The aforementioned effect is further enhanced by making arrangement such that the angle-bars are rotated automatically in association with the operation of the rotary printing press.

The above-mentioned and other objects, aspects and advantages of the present invention will become apparent to those skilled in the art by making reference to the following detailed description and the accompanying drawings in which a preferred embodiment incorporating the principles of the present invention is shown by way of an example only.

DETAILED DESCRIPTION OF THE PREFERRED EMBODIMENT

Figure 1:
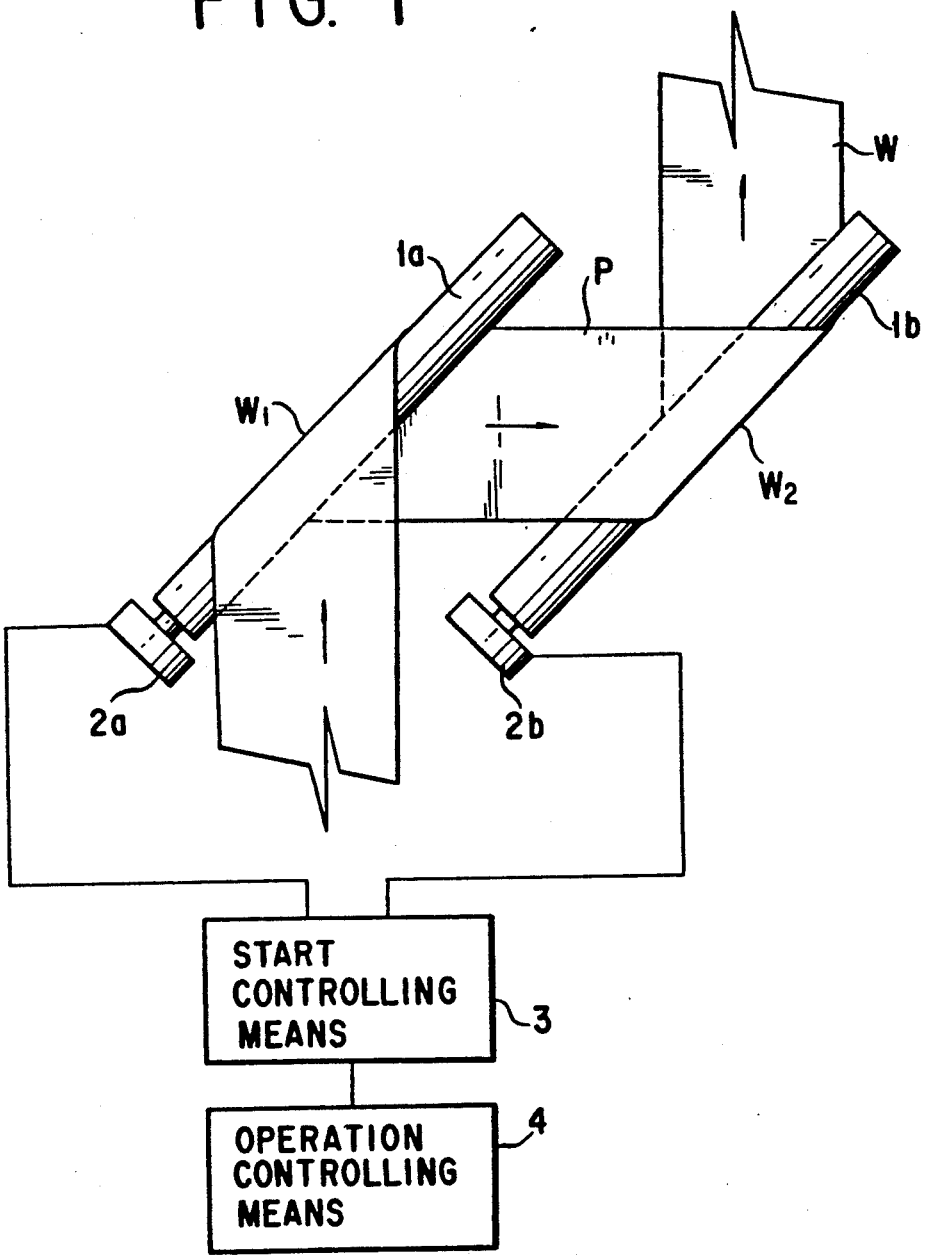
FIG. 1 is a schematic, configurational explanatory view showing one embodiment of the present invention.
Figure 2:
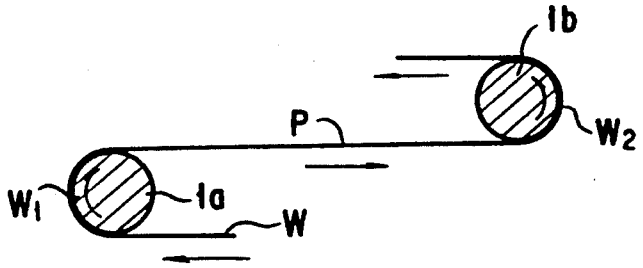
FIGS. 2 and 3 are sectional views, respectively, when looking two pieces of angle bars shown in FIG. 1 in the axial direction thereof.
Figure 3:
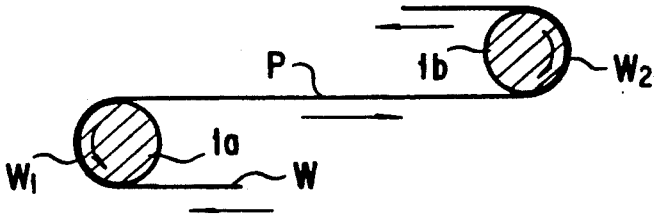
Figure 4:
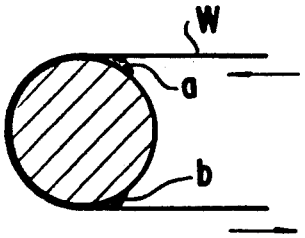
FIG. 4 is a fragmentary, enlarged sectional view showing the relationship between a paper web and one piece of angle-bar.

The present invention will now be described below in more detail by way of one embodiment thereof with reference to the accompanying drawings, FIG. 1 is a schematic, configurational view of one embodiment of the present invention, and FIGS. 2 and 3 are sectional, side views when looking the angle-bars shown in FIG. 1 in the axial direction thereof, which show the direction of running of a paper web W and directions of rotations of the angle-bars 1*a* and 1*b*. FIG. 4 is a sectional view of one piece of angle bar guiding a paper web.

A paper web W is threaded along a path from a paper web supply section (not shown) of a rotary printing press to a paper web folding section (not shown), and is guided around the peripheral surfaces of the angle-bars 1*a*, 1*b* on the way of the path.

The angle-bars 1*a* and 1*b* are supported rotatably relative to a frame (not shown) of the rotary printing press at a predetermined angle to the direction of advancement of the paper web W.

The angle-bars 1*a*, 1*b* are provided at their respective one axial end with driving means 2*a*, 2*b*, which rotate continuously the angle-bars 1*a*, 1*b*, respectively.

The driving means 2*a*, 2*b* are each provided with a driver (not shown) such as, for example, an electric motor which is connected to a mechanical speed reduction means such as, for example, a worm reduction gear (not shown), and which may be further provided, as occasion demands, with another proper speed reduction means (not shown) such as, for example, an electrically controlled speed reduction means in combination. A start controlling means 3 which will be described later may fulfill the function of the electrically controlled speed reduction means in combination. Further, the driving means 2*a*, 2*b* may be driven by one piece of driver. The start controlling means 3 is connected with the driving means 2*a* and 2*b*, respectively, and transmits a signal as an output to each of the driving means 2*a*, 2*b* to drive each of the angle-bars 1*a*, 1*b* at a preset direction of rotation and at a preset rotational speed. And, connected with the start controlling means 3 is an operation controlling means 4 for controlling the operation of the rotary printing press, which serves to transmit a signal, which is indicative of whether the rotary printing press is in operation or at a stop, to the start controlling means 3.

In the next place, the operation of the angle bar device according to the present invention will be described.

In FIG. 1, upon completion of threading the paper web W along its relevant path and when a command for commencement of operation is sent out by the operation controlling means 4, the rotary printing press is rendered operative. With the operation of the rotary printing press, the paper web W begins to run, and simultaneously therewith the start controlling means 3 transmits a starting signal to each of the driving means 2a, 2b to start the latter, to thereby rotate continuously each of the angle-bars 1a, 1b in a direction and at a rotational speed preset by the start controlling means 3. The details of the rotation of the angle-bars 1a, 1b are as follows.

That is to say; the peripheral speed of each of the angle-bars 1a, 1b shown in FIGS. 2 and 3 is remarkably slower than the speed of running of the paper web W, and is less than one 10,000th, for example, of the running speed of the paper web W in the normal printing condition. The rotational speeds of the angle-bars 1a, 1b give little influence on the balance of tension and the direction of advancement of the moving paper web W which is guided around the peripheral surfaces of the angle-bars 1a and 1b and in contact therewith in the same manner as in the case of prior art angle bars (not shown) which are not rotatively driven. Further, to increase the tension on the intermediate portion P of the paper web W and to avoid formation of a slack and variation in frictional resistance on the portions $W_1$ and $W_2$ of the paper web which are held in contact with the angle-bars 1a, 1b, the direction of rotation of each of the angle-bars 1a, 1b is a forward direction of rotation which corresponds to the direction of running of the paper web W as shown by arrows in FIG. 2 and the rotational speed of the upstream angle-bar 1a is kept somewhat slower than that of the downstream angle-bar 1b, or the direction of rotation of the upstream angle-bar 1a is a reverse direction of rotation which is opposite to the direction of running of the paper web W and that of the downstream angle-bar 1b is the forward direction of rotation, while the rotational speed of the upstream angle-bar 1a is kept somewhat faster than that of the downstream angle-bar 1b.

Upon completion of the printing operation, a command for stopping the operation is sent out by the operation controlling means 4 to stop the rotary printing press, and at the same time a signal for stopping each of the driving means 2a, 2b is outputted by the start controlling means 3 to stop the driving means 2a, 2b to thereby stop the rotation of both the angle-bars 1a and 1b.

Further, the above-mentioned reduction gear, not shown, and/or the electrically controlled speed reduction means may be manually adjusted to alter the preset speed reduction ratio depending on, for example, the quality of paper web to be used. Still further, when the angle-bars 1a, 1b are used with the speed reduction ratio kept at a fixed value, the speed reduction means may be a power transmission arrangement having a fixed speed reduction ratio which is interposed between one axial end of each of the angle-bars 1a, 1b and a driver.

This invention is not limited to the above-mentioned embodiment and covers various changes and modifications in design thereof which do not depart from the scope of claims and which include, for example, disconnecting the start controlling means 3 from the operation controlling means 4, or keeping the start controlling means 3 as it is connected with the operation controlling means 4 and making arrangement such that the start controlling means 3 can be independently operated, or making arrangement such that the angle-bars 1a, 1b can be started and/or stopped separately from the operation of the rotary printing press, etc.

What is claimed is:

1. An angle-bar device for use in a rotary printing press which is put to use by allowing paper webs to run along their relevant paths, comprising:

at least two angle-bars disposed rotatively and spaced upstream and downstream from each other in the direction of running of a paper web, each of said angle-bars being inclined at an angle other than ninety degrees relative to said direction of running of the paper web so as to laterally displace the path of movement of the web from a first path of movement of the web as the web approaches the upstream angle-bar to a second path of movement of the web as the web leaves the downstream angle-bar;

driving means separate from the driving web for rotatively driving each of said angle-bars;

a start controlling means connected operatively with said driving means and adapted to control the starting of the driving means; and means for controlling the drive means to each of said angle-bars so that each of said upstream and downstream angle-bars is rotated to increase the tension exerted on the paper web running around and between the angle-bars.

2. An angle-bar device as claimed in claim 1, characterized in that each of said angle bar driving means drives each of said upstream and downstream angle-bars at a preset rotational speed and in a preset rotational direction.

3. An angle-bar device as claimed in claim 2, characterized in that the peripheral speed of each of said angle-bars is less than one 10,000th of the running speed of the paper web.

4. An angle bar device as claimed in claim 2, characterized in that, as regards the rotational directions of said angle-bars, the direction of rotation of each of the upstream and downstream angle-bars is a forward direction of rotation which corresponds to the direction of running of the paper web, and the direction of rotation of the upstream angle-bar is kept somewhat slower than that of the downstream angle-bar.

5. An angle-bar device as claimed in claim 2, characterized in that, as regards the direction of rotation of said angle-bars, the direction of rotation of the upstream angle-bar is a reverse direction of rotation which is opposite to the direction of running of the paper web, and that of downstream angle-bar is a forward direction of rotation which corresponds to the direction of running of the paper web, while the rotational speed of the upstream angle-bar is kept somewhat faster than that of the downstream angle-bar.

6. An angle-bar device as claimed in claim 2, characterized in that said start controlling means is connected with an operation controlling means for detecting the operating condition of the rotary printing press so that an output signal transmitted by the operation controlling means is inputted to the start controlling means.

* * * * *